US005735638A

United States Patent [19]

Beamer

[11] Patent Number: 5,735,638

[45] Date of Patent: Apr. 7, 1998

[54] APPARATUS FOR LINING A TRENCH

[75] Inventor: John V. Beamer, Atlanta, Ga.

[73] Assignee: Hoosier Group, L.L.C., Atlanta, Ga.

[21] Appl. No.: 584,170

[22] Filed: Jan. 11, 1996

Related U.S. Application Data

[63] Continuation-in-part of Ser. No. 287,654, Aug. 9, 1994, Pat. No. 5,573,351.

[51] Int. Cl.[6] ..... E01F 5/00

[52] U.S. Cl. ..... 405/119; 404/4; 405/118

[58] Field of Search ..... 405/118–122, 52; 404/2, 4

[56] References Cited

U.S. PATENT DOCUMENTS

| | | | |
|---|---|---|---|
| 1,180,621 | 4/1916 | Thorsby | 405/122 |
| 3,156,099 | 11/1964 | Dailey | 405/121 |
| 4,940,359 | 7/1990 | Van Duyn et al. | 404/2 X |
| 4,968,179 | 11/1990 | Frahm | 405/52 X |
| 5,181,793 | 1/1993 | Dekel | 404/4 |
| 5,213,438 | 5/1993 | Barenwald | 404/2 |

*Primary Examiner*—Dennis L. Taylor
*Attorney, Agent, or Firm*—Needle & Rosenberg, P.C.

[57] ABSTRACT

A trench liner system used for forming a single or dual containment trench comprising a primary liner alone or a primary liner with a secondary liner. In a single containment trench, a primary liner means extends along the length of the trench, and includes a plurality of ribs or pleats spaced laterally along the exterior side of the primary liner, so that the primary liner means is supported within the trench by the ribs or pleats and plurality of cavities are formed between the primary liner means and the trench wall and bottom. For a dual containment trench, the secondary liner means also comprises a plurality of ribs or pleats spaced along the exterior side of the secondary liner, so that the secondary liner means is supported by the ribs or pleats and a plurality of cavities are formed between the secondary liner means and the trench wall and bottom. The primary liner is disposed upon the secondary liner such that the exterior surface of the primary liner is in contact with the interior surface of the secondary liner. The primary liner is also supported by ribs or pleats and a plurality of cavities are formed between the primary liner and the secondary liner.

16 Claims, 8 Drawing Sheets

APPARATUS FOR LINING A TRENCH

CROSS-REFERENCE TO RELATED APPLICATION

This application is a continuation-in-part of application Ser. No. 08/287,654, filed Aug. 9, 1994, entitled "Method and Apparatus for Relining or Forming a Trench", now U.S. Pat. No. 5,573,351.

BACKGROUND OF THE INVENTION

1. Field of the Invention

The present invention relates to the construction industry and, more specifically, to the formation of a trench lining system which can renew a system that is wearing or worn out, that can turn an in-place trench into a dual containment trench system, that may be used in new construction to form a trench resistant to a wide variety of chemicals as either single or dual containment at a much lower cost than prior systems.

2. Description of the Prior Art

The general concept of trench drainage has long been used. Trenches are used where liquid run-offs occur, such as chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it and, in some applications, they are solidly covered, such as crossing sidewalks or where conduits are carried within the trench and fluid entry is minimal and not necessarily desirable.

In the prior art, worn out trenches had to be completely removed by cutting the surrounding concrete, removing all brick linings when present, removing the frames and effectively then starting over again to build a new trench. In the prior art, there was no way to convert an existing trench into a dual containment trench, or to build a trench by conventional ways and at the same time turn it into a dual containment trench.

Thus, there exists a world-wide need for an economical method to line a trench.

There also exists a need for an economical way to construct a dual containment trench.

There also exists a need for a system to line a trench without replacing it in its entirety.

There also exists a need for a system to convert a trench from a single containment to a dual containment system.

There also exists a need to provide a means to build a trench by conventional means and subsequently turn it into a dual containment system.

There also exists a need for a system which can be rapidly installed decreasing plant down time.

SUMMARY OF THE INVENTION

The disadvantages of the prior art are overcome by the present invention, which relates to a grate or solid covered trench to be replaced or constructed by conventional means.

The present invention is a trench liner system for lining a trench having at least two walls and a bottom as either a single containment or as a double containment trench. It comprises a primary liner means, with an interior surface and an exterior surface disposed within the trench walls and bottom and extending along the length of the trench and a means for holding the primary liner means against the trench walls.

The primary liner means also comprises a plurality of ribs laterally spaced along, and extending above, the exterior surface of the primary liner means so that the exterior surface of the primary liner means is supported on the ribs on the trench walls and bottom. This defines a plurality of cavities between the exterior surface of the primary liner means, between the ribs and the trench walls and bottom.

In another preferred embodiment for a single containment trench, the primary liner contains pleats laterally spaced along, and extending above the exterior surface of the primary liner means. The pleats allow for the expansion and contraction of the primary liner as well as support the primary liner on the trench walls and bottom. This defines a plurality of cavities between the exterior surface of the primary liner means, between the pleats and the trench walls and bottom.

The present invention is also embodied as a system of creating a dual containment trench comprising a secondary liner means, with an interior surface and an exterior surface, disposed within the trench and extending along the length of the trench; a primary liner means, having an interior surface and an exterior surface, disposed within the secondary liner means and extending along the length of the trench; and a means for holding the primary liner means and the secondary liner means against the trench walls.

In this alternative preferred embodiment, both the primary liner means and the secondary liner means comprise a plurality of ribs spaced along the exterior surface of each liner means, respectively, so that the exterior surface of both the primary and secondary liner means is supported on the ribs. This defines two sets of cavities. One set of cavities is defined by the exterior surface of the secondary liner means, between the ribs of the secondary liner means and the trench walls and bottom. The other set of cavities is defined by the exterior surface of the primary liner means, between the ribs of the primary liner means and the interior surface of the secondary liner means.

In another preferred embodiment for a dual containment trench, the ribs may be placed solely on the secondary liner means. In this embodiment, the exterior and interior surfaces of the primary liner means would be substantially smooth. The secondary liner means, on the other hand, would comprise a plurality of ribs spaced along the exterior surface and the interior surface of the secondary liner means. This embodiment also defines two sets of cavities. One set of cavities is defined by the exterior surface of the secondary liner means, between the ribs of the secondary liner means and the trench walls and bottom. The other set of cavities is defined by the exterior surface of the primary liner means, between the ribs of the secondary liner means and the interior surface of the secondary liner means.

The cavities allow for the downward flow of fluid. In addition, each rib may have an opening defining a gap which is in fluid communication with the cavities. A fluid sensor may be set in the gap or at a low point in the trench to detect fluids that have leaked into the gap either through the primary liner means or through the secondary liner means. The gap may also drain into a visual inspection tank to detect leaks in either liner means.

In another embodiment for a dual containment trench, the secondary liner means contains pleats spaced along and extending above both the interior and exterior surface of the secondary liner. The pleats allow for the expansion and contraction of the primary liner and secondary liner as well as support the secondary liner on the trench walls and support the primary liner on the secondary liner.

When the shape of the primary liner means or the shape of the secondary liner means does not conform exactly to the shape of the trench walls and bottom, a means for supporting either the primary liner means or the secondary liner means may be disposed within the trench along the junction where the trench bottom meets the trench walls. The support means also comprises an interior surface and an exterior surface. The interior surface of the support means is complimentary in shape to the exterior surface of the primary or secondary liner means. The exterior surface of the support means is complimentary in shape to the junction defined by the trench bottom and the trench walls.

In order to hold the primary liner means upright or where a secondary liner means is used, in order to hold the primary and secondary liner means upright, both liner means have an upper portion. The holding means comprises a vertical member having an upper end and an opposite lower end, with a first horizontal member extending from the upper end and terminating in a first edge. A first wall depends from the first edge and a second horizontal member extends from the lower end away from the first horizontal member. The second horizontal member terminates in a second edge having a second wall depending therefrom. The top surface of the trench wall may have an opening therein to receive a portion of the first depending wall, the second depending wall overlying the upper portion of the primary liner means. The vertical member has an inner surface and an opposite outer surface, the second horizontal member has a lower surface and an opposite upper surface. In this embodiment, the outer surface of the vertical member and the upper surface of the second horizontal member form a ledge adapted to receive grates and covers.

The holding means may be secured to the existing trench wall by employing one of several methods. The second horizontal member may define a first opening passing therethrough with a portion of the upper end defining a second opening adapted to receive a bolt passing through the first opening, thereby securing the holding means to the trench wall. In employing another method of securing the holding means, the second wall defines a first opening passing therethrough and a portion of the trench wall defines a second opening adapted to receive a bolt passing through the first opening, thereby securing the holding means to the trench wall. Cement, or other sealants, may also be used to secure the holding means to the existing trench wall.

In yet another preferred embodiment, the holding means comprises a horizontal member having a first end and a second end and a wall depending from the second end. The depending wall overlies the upper portion of the primary liner means. The trench wall may define an opening or groove therein to receive a portion of the horizontal member.

The holding means can also be substantially U-shaped and comprise a horizontal member having a first end with a first wall depending therefrom and an opposed second end with a second wall depending therefrom. In this embodiment, the top surface of the trench wall has an opening therein to receive a portion of the first depending wall and the second depending wall overlies the upper portion of the primary liner means.

Another frame design, essentially the same as disclosed in U.S. Pat. Nos. 4,993,877; 4,993,878; 5,000,621; 5,256,000; and 5,281,052, may be used. In this embodiment, each of the frames may include an adjustable anchoring means to position the frame to the proper elevation before pouring concrete or other materials. A piece of hanger material, such as a wooden 4×4, or a steel channel may be placed across the trench at various points along the trench. The frames are suspended from the hangar material using wire or nuts and bolts to hold the frames at the proper finished elevation.

The trench containment unit is extremely flexible in allowing continuous walls with no joints for two hundred feet or more. The trench containment unit should be an unbroken unit as long as possible to minimize the number of joints which might leak. The primary and secondary walls can be neutral or sloping as needed. Where long trenches occur, there will be expansion of the trench walls beyond the length of the frames. This expansion must be unimpeded but accommodations for added length, turns and intersections may be added as needed.

To form a place for the new frame, the concrete or other material must be cut behind and under the current trench frame far enough for the new frame to fit and be held securely once the frame is in place. Once accomplished, the frame may be removed from its anchor plates (although it does not have to be). Once removed, for a dual containment trench, the new support means, if needed, are installed and the secondary liner means is then placed snugly inside the trench walls and bottom and on top of the support means. The primary liner means is then placed snugly inside the secondary liner means. For a single containment trench, the primary liner means is placed snugly inside the trench walls and bottom and on top of the support means, if used. The top of the primary liner means and the secondary liner means, if used, are placed snugly behind the lower part of the frame. Sealants may be used between the frame and the concrete, behind the bolts securing the frame to its base, and between frame sections.

Expansion and contraction will be accommodated by the design of the wall ribs or by the methods used in U.S. Pat. Nos. 5,256,000 and 5,281,052.

It is an object of the present invention to provide an improved containment trench.

It is also an object of the present invention to provide a means to renew a trench without replacing it in its entirety.

It is also an object of the present invention to provide a means to convert an existing trench from a single containment system to a dual containment system.

These and other objects will become apparent from the following description of the preferred embodiment taken in conjunction with the following drawings, although variations and modifications may be effected without departing from the spirit and scope of the novel concepts of the disclosure.

DETAILED DESCRIPTION OF THE PREFERRED EMBODIMENTS

Figure 1:
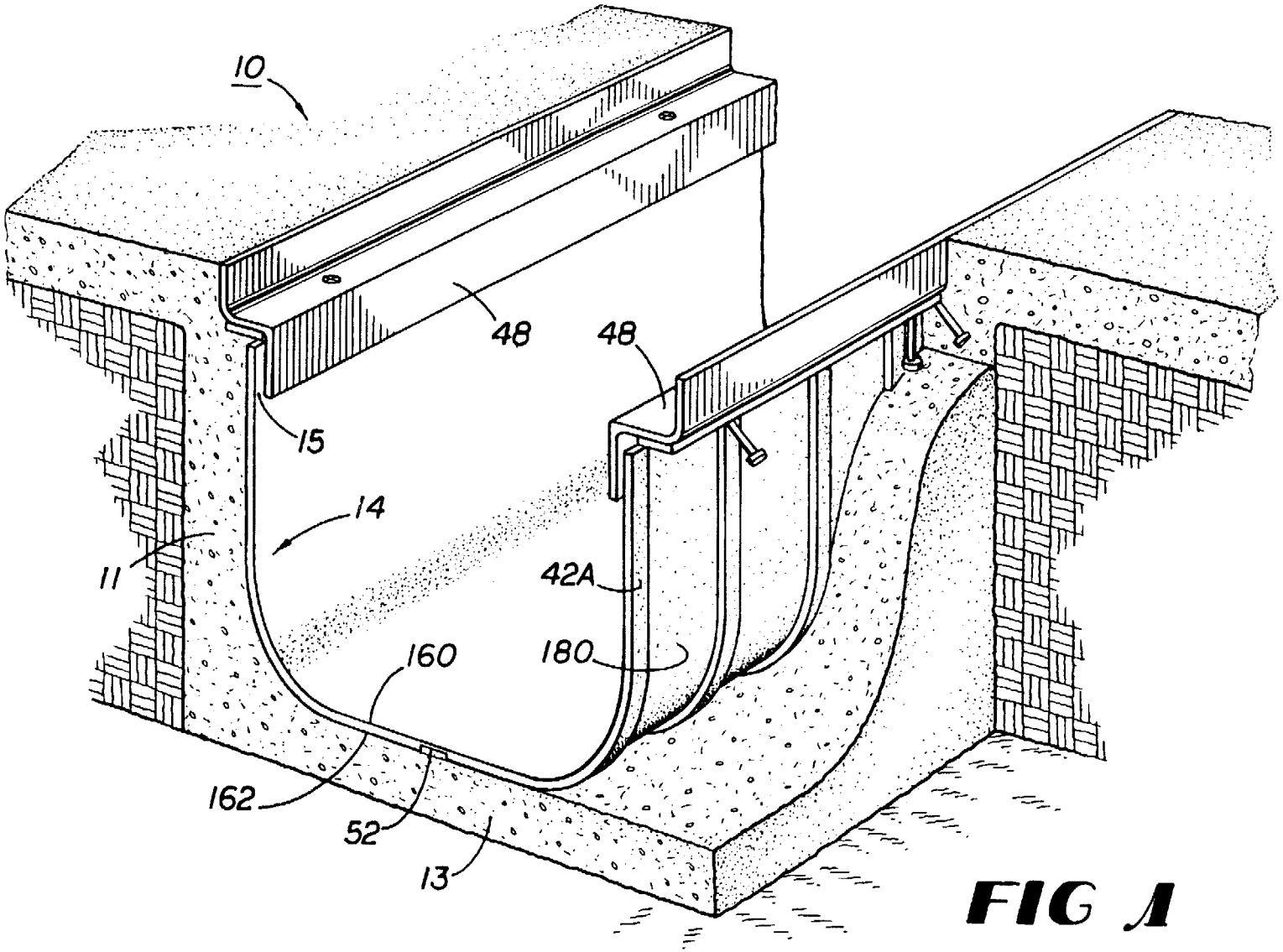
FIG. 1 is a perspective view of a trench assembly of the present invention having a single-walled curved design.

Referring to FIG. 1, a preferred embodiment of the present invention 10, a single-walled curved bottom trench, is shown. It comprises a primary liner means 14, having an interior surface 160 and an exterior surface 162, disposed along the length of the trench. The interior surface 160 of the primary liner means 14 has an upper portion 15.

The primary liner means 14 comprises a material (e.g., fiberglass, plastic, stainless steel, coated steel, or any other formable material) that is resistant to the fluids which the trench is designed to hold. The primary liner means 14 is affixed to the existing trench wall 11 with a means 48 for holding the primary liner means 14 to the trench wall 11. The primary liner means 14 is not attached to the trench wall 11 except through the holding means 48, allowing the primary liner 14 to expand and contract along its length. This also allows for the easy removal and replacement of the holding means 48 and the primary liner means 14.

Figure 2:
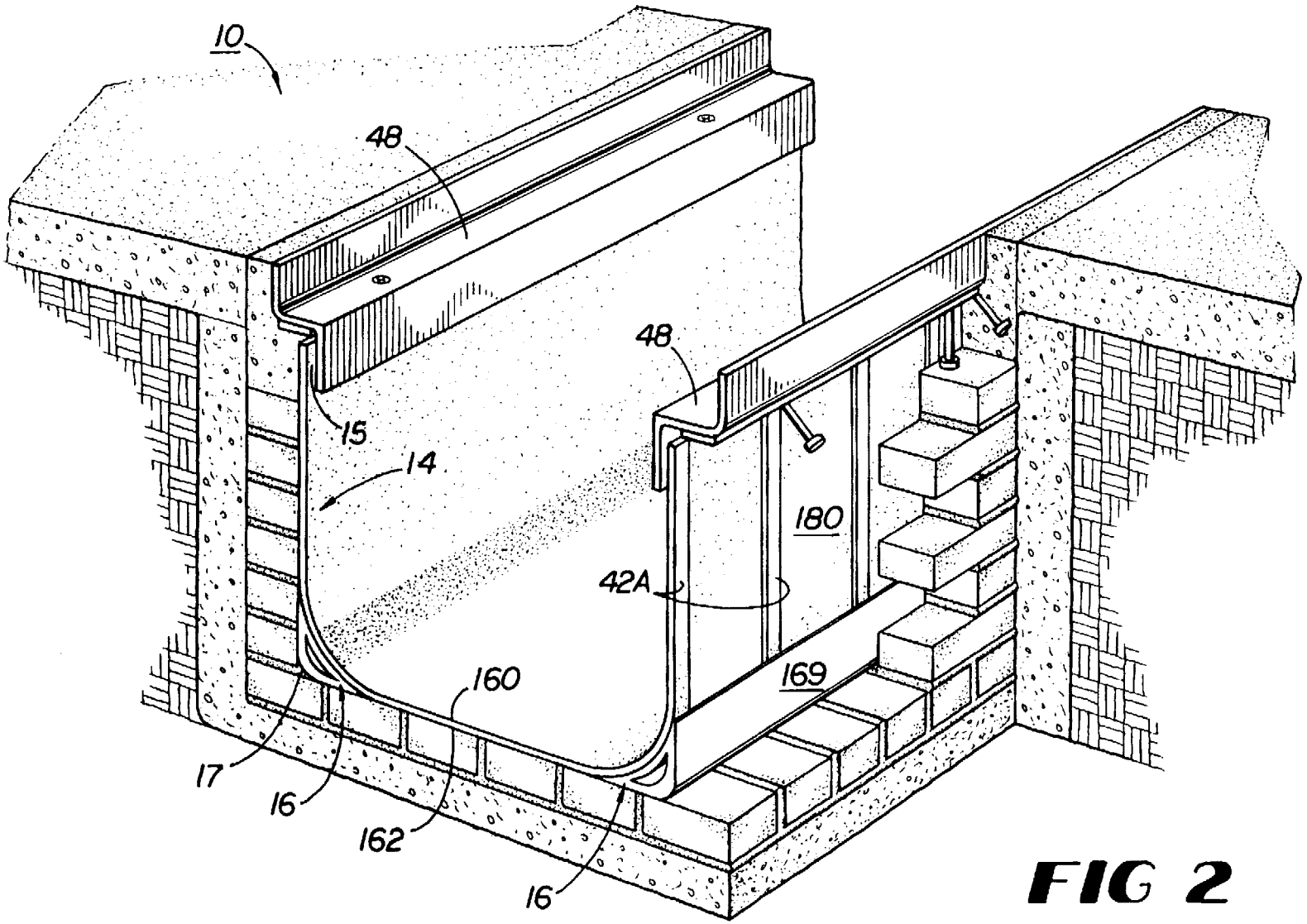
FIG. 2 is a perspective view of a trench assembly of the present invention having a single-walled rectangular design.
Figure 3:
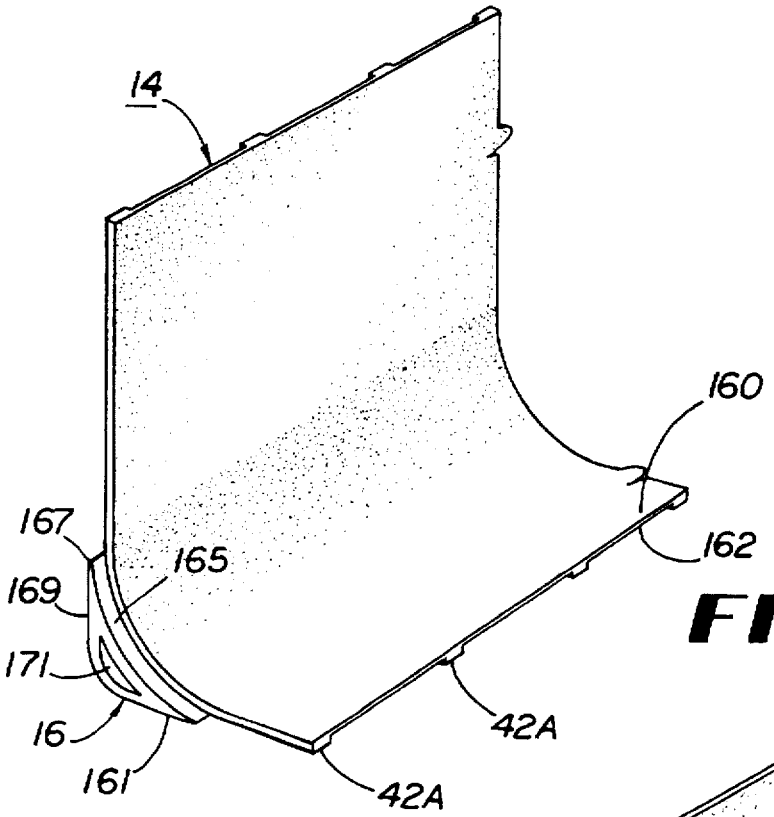
FIG. 3 is a perspective view of a primary liner means with ribs.

Referring to FIGS. 1, 2 and 3, the primary liner 14 has a plurality of spaced-apart ribs 42A disposed laterally or substantially vertically on the exterior surface 162 of the primary liner 14 along its length. The primary liner means 14 rests within an existing trench 11 with the exterior surface 162 adjacent the trench walls and bottom. The ribs 42A of the primary liner means 14 separates the primary liner means 14 from the trench wall 11 and bottom 13, thereby defining a plurality of cavities 180 therebetween.

The ribs 42A may be substantially vertical and continuous and each rib may contain a break near the lowest point of the trench forming a gap 52 between the distal edges of the ribs. Through the gap 52 can be placed a means (not shown) for fluid detection within the gap 52. The fluid detecting means may be an electronic fluid sensor, a single point or visual means of detecting fluids that have leaked out of the primary liner means 14 down the cavities 180 into the gap 52.

Referring to FIG. 1, in a preferred embodiment of the present invention 10, a single-walled, curved bottom trench is shown. In some embodiments, however, the shape of the existing trench wall 11 is not necessarily curved but rectangular. Therefore, another preferred embodiment of the present invention as shown in FIGS. 2 and 3 further includes a support means 16 which rests within an existing trench. As seen most clearly in FIG. 3 support means 16 comprises two opposed elongated members 171 which are substantially parallel and may comprise a substantially L-shaped frame structure. Each elongated member 171 comprises an upright portion 169 and a lower horizontal portion 161 having a front surface 165, and an opposite rear surface 167. Each elongated member 171 is formed of a rigid material such as fiberglass, plastic, stainless steel, coated steel or any other formable material. The basic shape of each elongated member 171 will conform to the shape of the trench into which the elongated member 171 will be placed. In FIG. 2, the trench has a square bottom so the rear surface 167 of the elongated member 171 is shaped substantially square to fit in the outside corner 17 of trench 11.

Each elongated member 171 may be of varying heights, widths, lengths, and thicknesses. Typically, each elongated member 171 will be molded or formed to a specific size for the trench into which it is to be placed. The support means 16 may comprise a plurality of elongated members 171 having relatively short lengths, with space left between each unit member to accommodate any expansion or contraction that might occur. Support means 16 could also be continuous.

Figure 4:
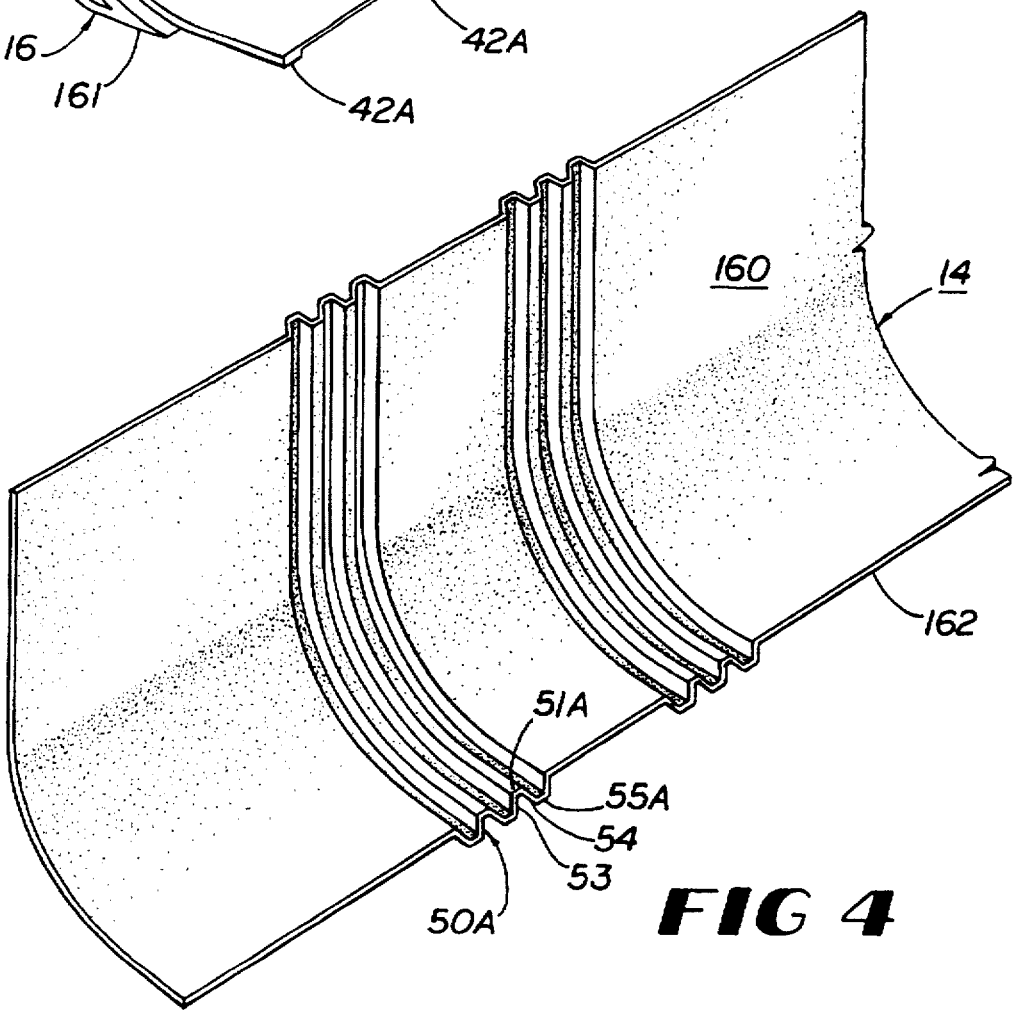
FIG. 4 is a perspective view of a primary liner means with pleats.

Referring to FIG. 4, in another preferred embodiment for a single containment trench, the primary liner 14 contains alternately directed pleats 50A in spaced relationship laterally extending along the primary liner means 14. Each pleat 50A has a top surface 51A a bottom surface 55A, a left surface 53 and a right surface 54. To minimize obstruction of the liquid runoff, the top surface 51A of each pleat is substantially flush with the interior surface 160 of the primary liner means 14.

Figure 5:
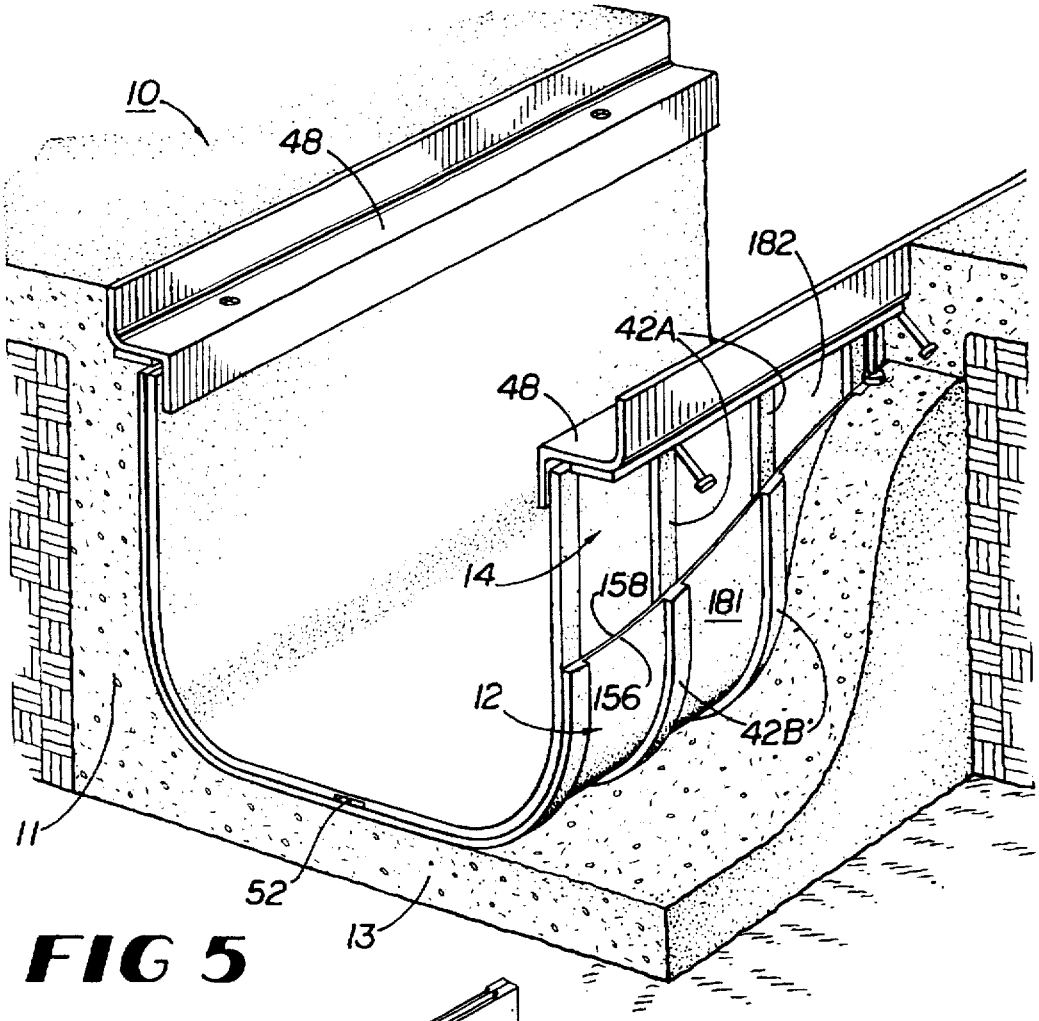
FIG. 5 is a perspective view of a double containment trench assembly of the present invention having a multi-walled curved design.

Referring to FIG. 5, the present invention is also embodied as a dual comment system. In this embodiment, the invention comprises a primary liner means 14 and a secondary liner means 12. The secondary liner means 12 has an exterior surface 156 and an interior surface 158. The interior surface 158 of the secondary liner means 12 has an upper portion (not shown). Both the primary liner 14 and the secondary liner 12 are constructed of a material (e.g., fiberglass, plastic, stainless steel, coated steel, or any other formable material) that is resistant to the fluids which the trench is designed to hold. The secondary liner 12 and the primary liner 14 are held against the existing trench wall 11 by a means 48 for holding the primary liner means 14 and the secondary liner means 12 upright against the trench wall 11. The primary liner 14 and the secondary liner 12 are not attached to each other, allowing the primary liner 14 and the secondary liner 12 to expand and contract along their lengths independently from each other.

Figure 6:
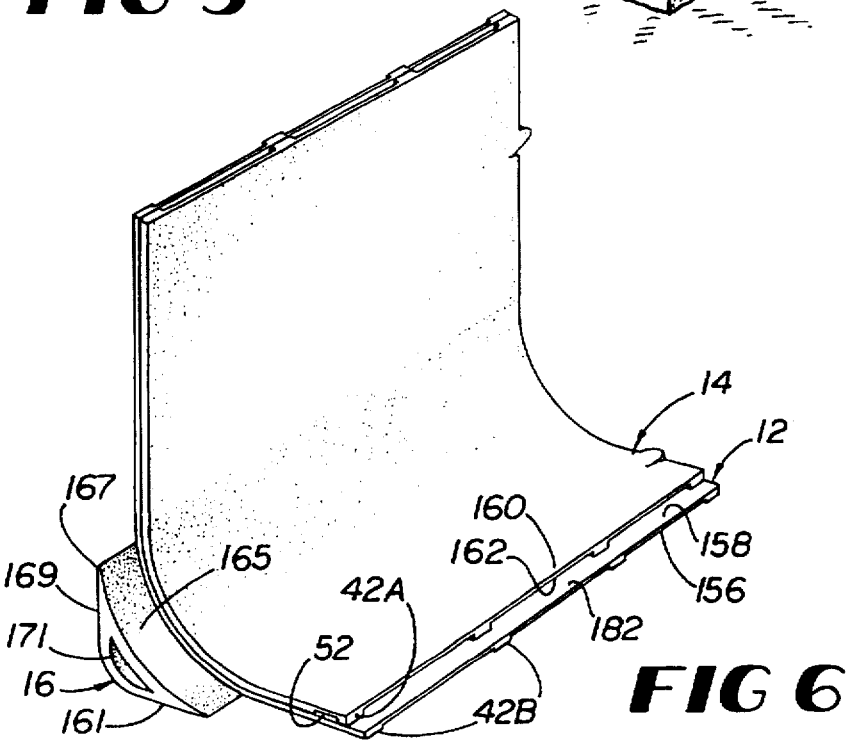
FIG. 6 is a perspective view of a primary and secondary liner means with ribs.

Referring to FIGS. 5 and 6, both the primary liner means 14 and the secondary liner means 12 have a plurality of ribs 42A and 42B, spaced substantially laterally or vertically along the exterior surface 162 of the primary liner means 14 and the exterior surface 156 of the secondary liner 12 along its length.

In a curved-bottom trench, as shown in FIG. 5, the secondary liner means rests within an existing trench 11 with the exterior surface 156 adjacent the trench wall and bottom. The ribs 42B on the secondary liner 12 separates the secondary liner 12 from the trench wall and bottom, thereby defining a plurality of cavities 181 therebetween. The primary liner 14 rests within the secondary liner 12. The exterior surface 162 of the primary liner 14 rests adjacent the interior surface 158 of the secondary liner 12. The ribs 42A on the primary liner 14 separate the primary liner 14 from the secondary liner 12, thereby defining a plurality of cavities 182 therebetween.

Figure 7:
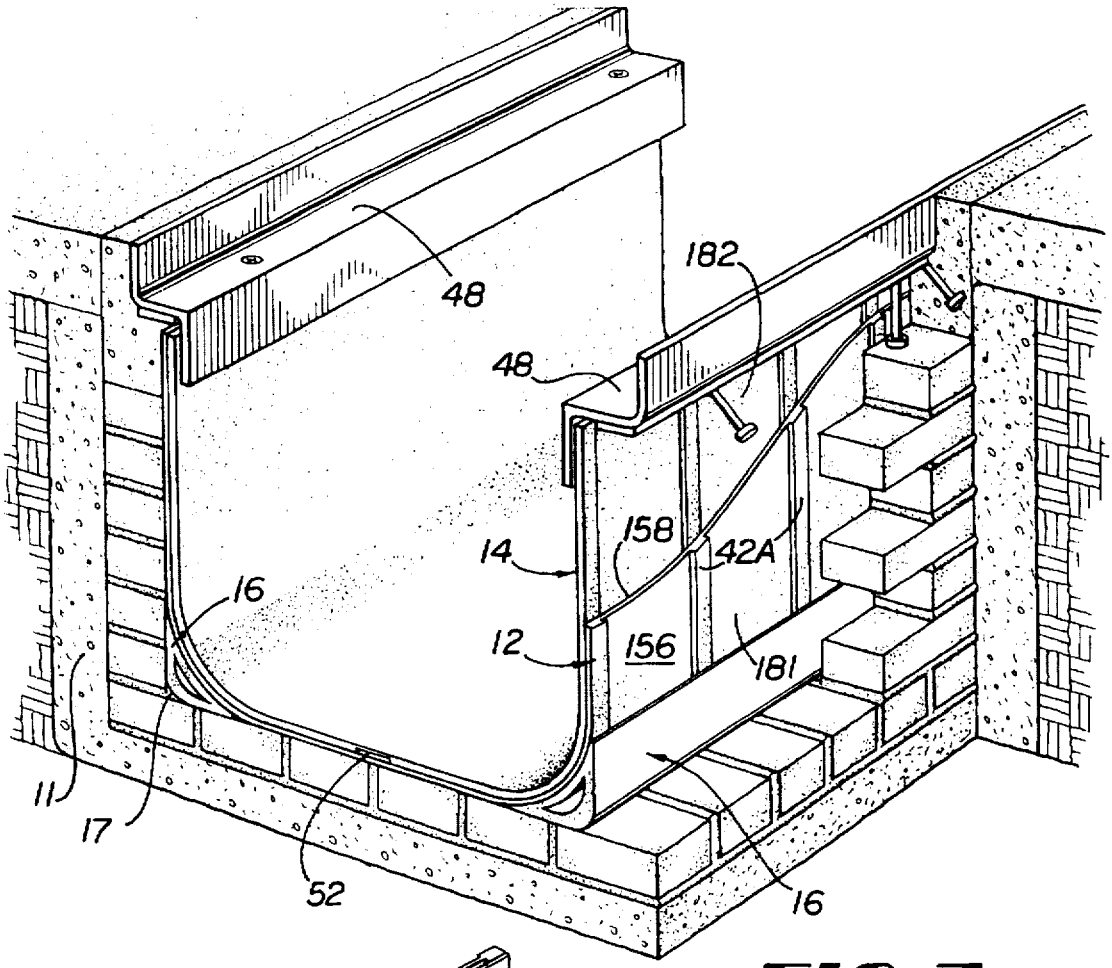
FIG. 7 is a perspective view of a double containment trench assembly of the present invention having a multi-walled rectangular design.

As shown in FIGS. 6 and 7, in a trench that does not contain a curved bottom, the present invention further includes a support means 16, which rests within the existing trench. The support means 16 is the same as described above for a single containment trench.

The ribs 42A on the primary liner means 14 may be continuous or may contain a break near the lowest point of the trench forming a gap 52 between the distal edges of the ribs. Through the gap 52 can be placed a means (not shown) for fluid detection within the gap 52. The fluid detecting means may be an electronic fluid sensor, a single point or visual means of detecting fluids that have leaked out of the primary liner means 14 down the cavities 182 into the gap 52.

Figure 8:
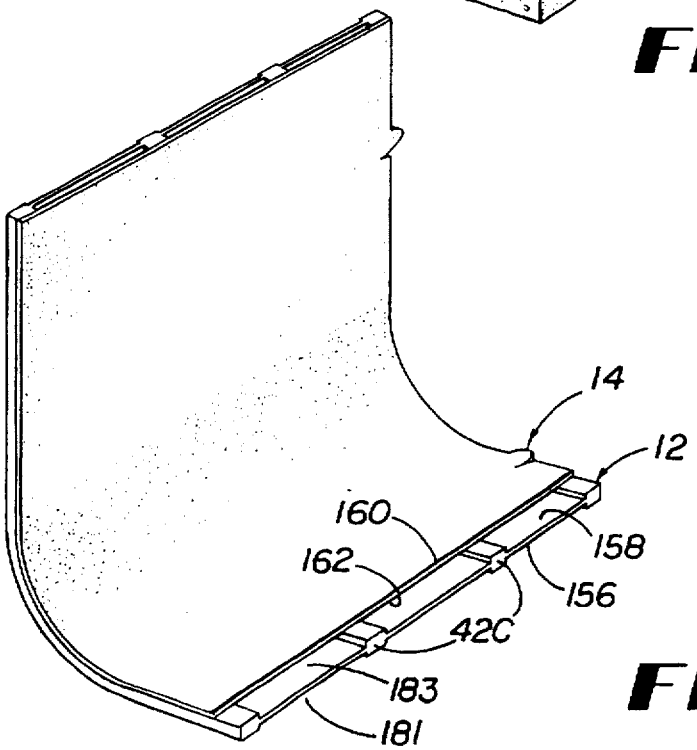
FIG. 8 is a perspective view of a primary and secondary liner means with the ribs solely on the secondary liner means.

Referring to FIG. 8, in another preferred embodiment for a dual containment trench the primary liner 14 has no ribs along its exterior surface. Instead, the secondary liner 12 contains ribs 42C on both the exterior surface 156 and the interior surface 158 which define therebetween respective cavities 183 and 181. One set of cavities 181 is defined between the ribs of the secondary liner means 12 by the exterior surface 156 of the secondary liner means 12, and the trench walls and bottom. The other set of cavities 183 is defined between the ribs of the secondary liner means 12 by the exterior surface 156 of the primary liner means 12, and the interior surface 158 of the secondary liner means 12.

The thickness of ribs 42A, 42B and 42C and their distance apart is determined by the materials from which the primary liner means 14 and the secondary liner means 12 are made. With many materials, significant expansion and contraction occurs as fluids pass through the trench at varying temperatures. Expansion and contraction also occur when there are no fluids in the trench at all. One important purpose of this invention is to maintain a space between the primary liner means 14 and the trench walls and bottom or between the secondary liner means 12 and the trench walls and bottom and between the primary liner means 14 and the secondary liner means 12 for when expansion or contraction occur. This is particularly important for the primary liner means 14 and secondary liner means 12. By properly spacing the ribs 42A, 42B and 42C of the proper thickness and shape, the expansion of the material in the primary liner means 14 and secondary liner means 12 will occur between the ribs in a rippling or "S" shaped or cupping way, minimizing the effects of the expansion in the overall trench, which could be hundreds of feet long.

Figure 9:
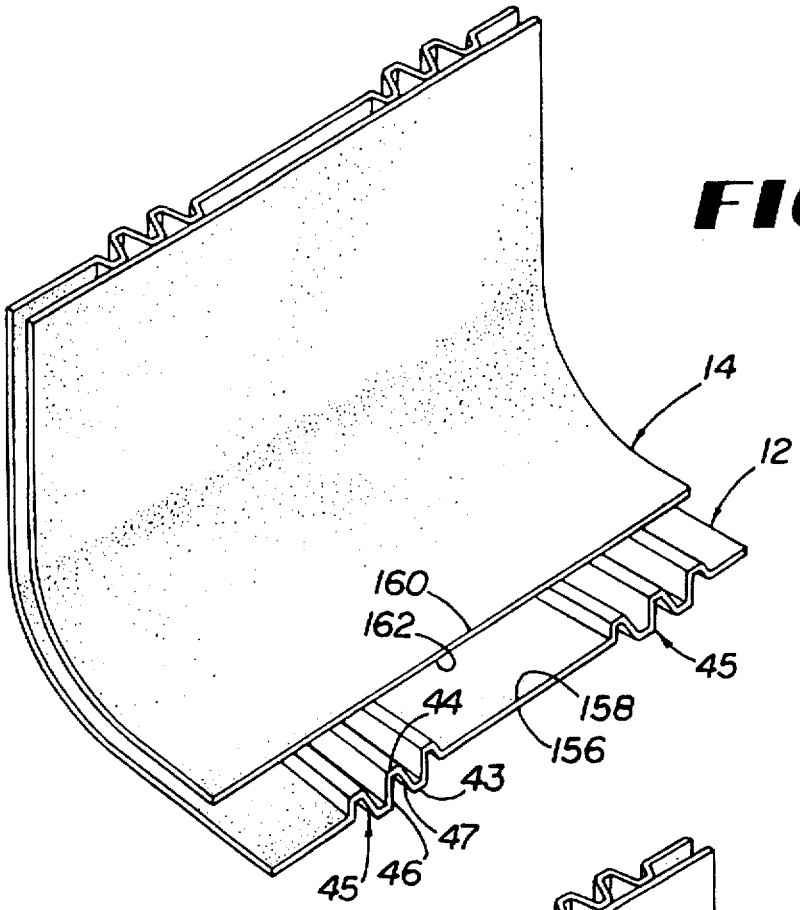
FIG. 9 is a perspective view of a substantially smooth primary liner means and a secondary lines means with pleats.

FIG. 9 is an alternative embodiment in which the secondary liner means 12 contains pleats 45, which are similar in design and construction as the pleats 50A as shown in FIG. 4. Each pleat 45 contains a top surface 44, a bottom surface 43, a right surface 47, and a left surface 46. The top surface 44 of the pleats extend above the interior surface 158 of the secondary liner means 12 and the bottom surface 43 of the pleats 45 extend below the exterior surface 156 of the secondary liner means 14. This allows the exterior surface 162 of the primary liner means 14 to be supported on the pleats 45, thereby defining a plurality of cavities between the pleats, the interior surface 158 of the secondary liner means 12 and the exterior surface 162 of the primary liner means 14. Also, the secondary liner means 12 is supported on the pleats 45, thereby defining a cavity between the pleats 45, the exterior surface 156 of the secondary liner means 12 and the trench walls and bottom.

Figure 10:
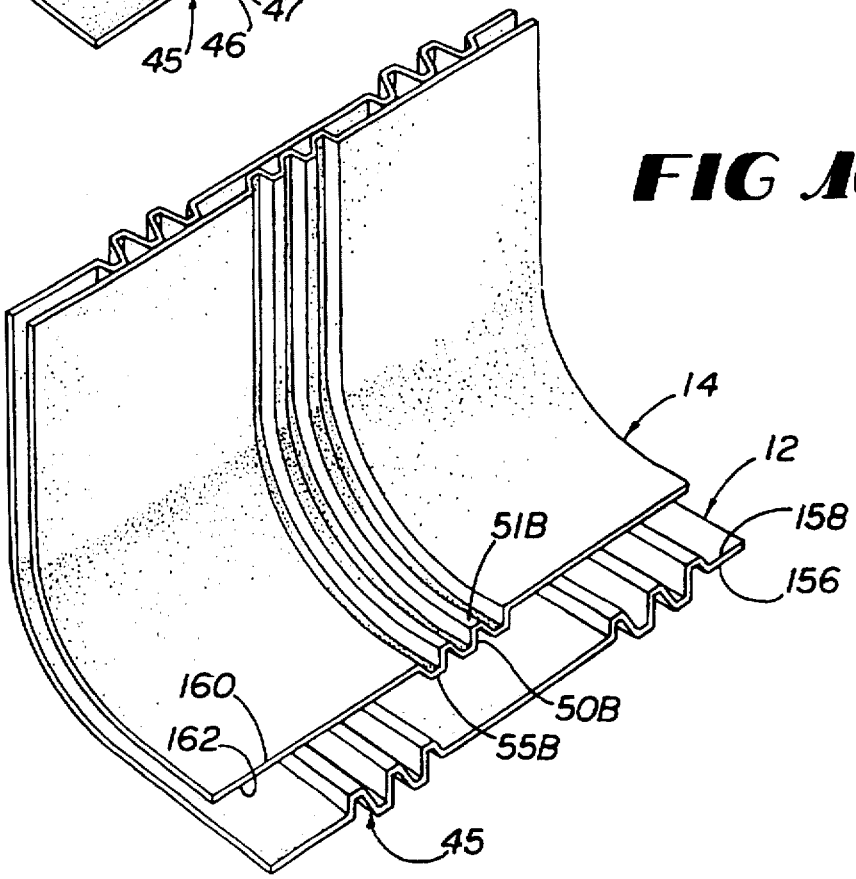
FIG. 10 is a perspective view of a primary liner means with pleats and a secondary liner means with pleats.

FIG. 10 is another preferred embodiment where both the primary liner means 14 and the secondary liner means 12 contain pleats. The pleats 50B on the primary liner means 14 are spaced along the primary liner means 14. Each bottom surface 55B on each pleat 50B extends below the exterior surface 162. The top surface 51B of each pleat 50B is substantially flush with the interior surface 160 of the primary liner means 14. The reason for this is to minimize obstruction of the liquid run-off. Also shown in FIG. 10 are the pleats 45 formed in the exterior and interior surfaces 156, 158 of the secondary liner 12.

As with the ribs described in this invention, the pleats also maintain a space for expansion or contraction between the primary liner means 14 and the trench walls and bottom or between the secondary liner means 12 and the trench walls and bottom and between the primary liner means 14 and the secondary liner means 12.

In addition to allowing the expansion to occur between the ribs in a rippling or "S" shaped way, the pleats also allow contraction or expansion by expanding or contracting themselves. Like an accordion, as expansion occurs, the pleats will be pulled apart. As contraction occurs, the pleats are drawn together.

Figure 11:
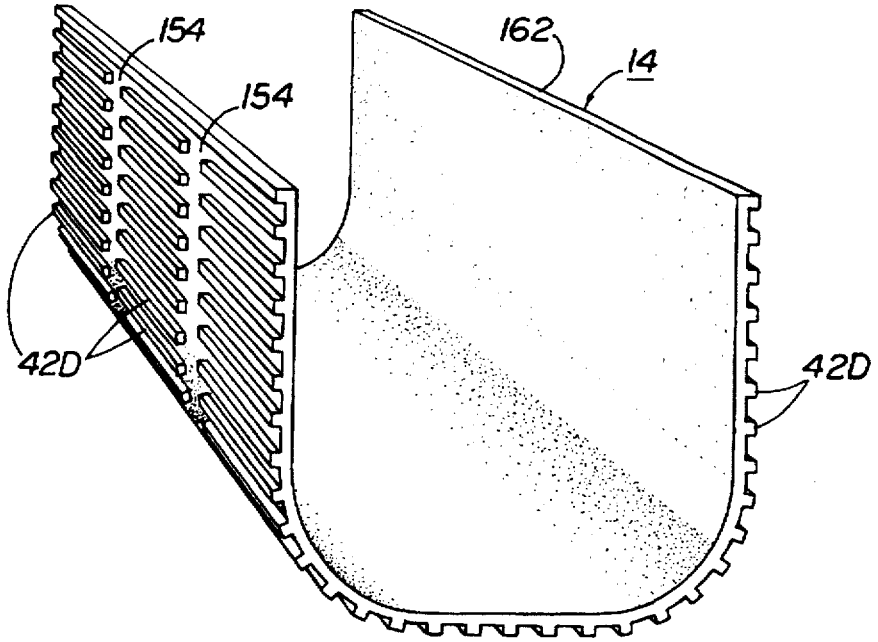
FIG. 11 is a perspective view of a primary liner means with a plurality of ribs disposed along its length.

FIG. 11 is an alternative embodiment in which the primary liner means 14 has a plurality of ribs 42D disposed substantially longitudinally along the exterior surface 162 of the primary liner means 14. A plurality of openings 154 in the ribs 42D may be placed along their length to allow for expansion and contraction and downward fluid drainage to a fluid sensing or detection unit. The actual shape of the ribs 42D could be rectangular, square, rounded or any other applicable shape, as would be obvious to one skilled in the art.

Figure 12:
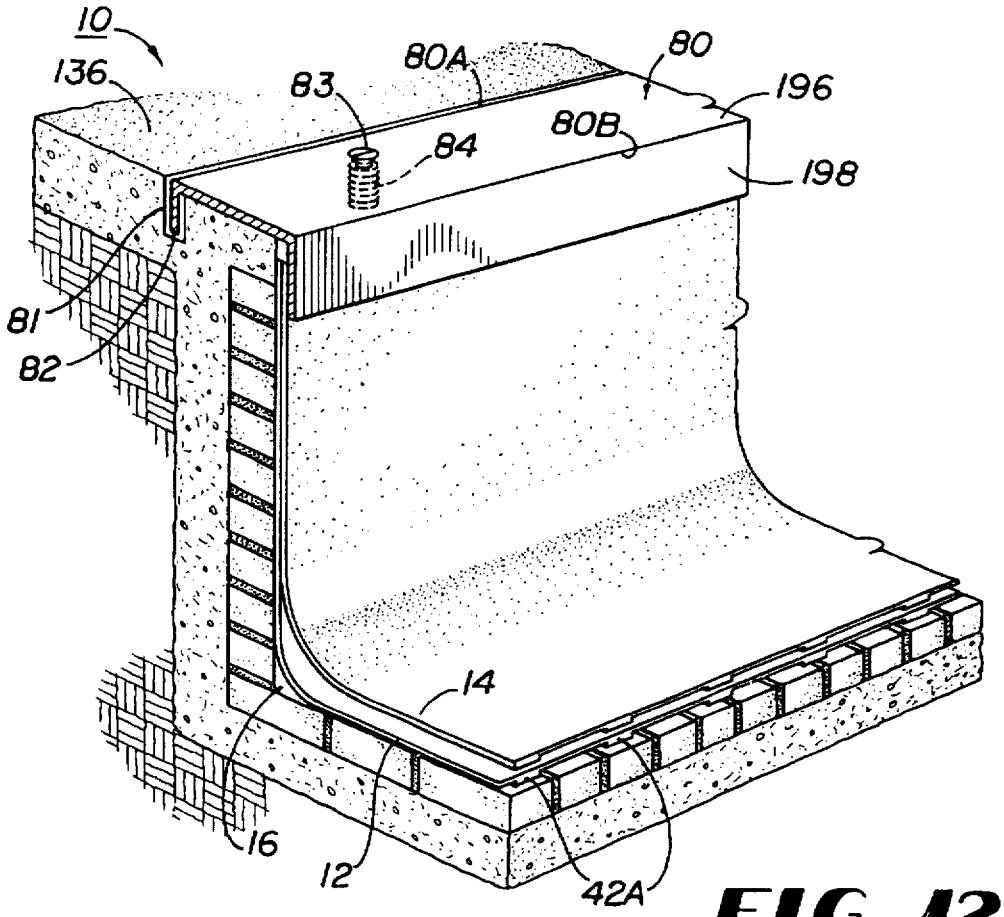
FIG. 12 is a partial perspective view of the trench assembly in which there are no frames, grates or covers.

FIG. 12 shows an embodiment of the trench with no frames, grates or covers within the trench wherein the holding means 80 is substantially U-shaped. It comprises a horizontal member 196 having a first side 80A with a first wall 82 depending therefrom and an opposed second side 80B with a second wall 198 depending therefrom. The top surface 136 of the trench wall has an opening 81 therein to receive a portion of the first depending wall 82 and the second depending wall 196 overlies the upper portion of the primary liner 14 and the secondary liner means 12. To line a trench 11, the support means 16 may be installed, if needed. The secondary liner means 12, if used, and the primary liner means 14 are put in place. U-shaped holding means 80 is fitted against the secondary liner means 12 and the primary liner 14 in a vertical fashion, leaving each enough room to move independently of one another.

The horizontal portion of the U-shaped holding means 80 is fastened to the surrounding surface with a bolt 83 extending from the surface into an expansion shield 84 holding the U-shaped holding means 80 in place. Sealants may be used in the opening 81 between the adjacent U-shaped holding means 80, the top surface 136, and between the adjacent U-shaped members along the trench. In some instances, it may be necessary to remove material under the U-shaped holding means 80 in order to make the top of the U-shaped holding means 80 level with the surface 136.

As shown in FIGS. 13*a*–13*d*, a preferred embodiment of the holding means 200 comprises a vertical member 210 having an upper end 212 and an opposite lower end 214, a first horizontal member 216 extending from the upper end 212 and terminating in a first edge 218. A first wall 220 depends from the first edge 218. A second horizontal member 230 extends outwardly from the lower end 214 and terminates in a second edge 232 having a second wall 234 depending therefrom. The top surface 208 of the trench wall 206 may have a vertical channel 240 therein to receive a portion of the first depending wall 220, with the second depending wall 234 overlying and maintaining in place the upper portion of the primary liner means 14 and/or the secondary liner means 12.

The vertical member 210 has an inner surface 250 and an opposite outer surface 252. The second horizontal member 230 has a lower surface 254 and an opposite upper surface 256. The outer surface 252 of the vertical member 210 and the upper surface 256 of the second horizontal member 230 form a ledge 260 adapted to receive a respective bearing surface of a trench gate or cover (not shown).

Figure 13A:
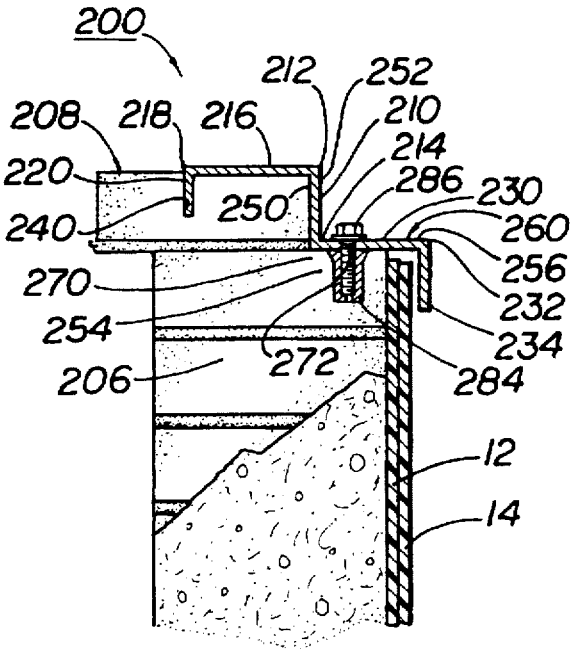
FIG. 13 are cross-sectional views of several alternative embodiments of the holding means.
Figure 13D:
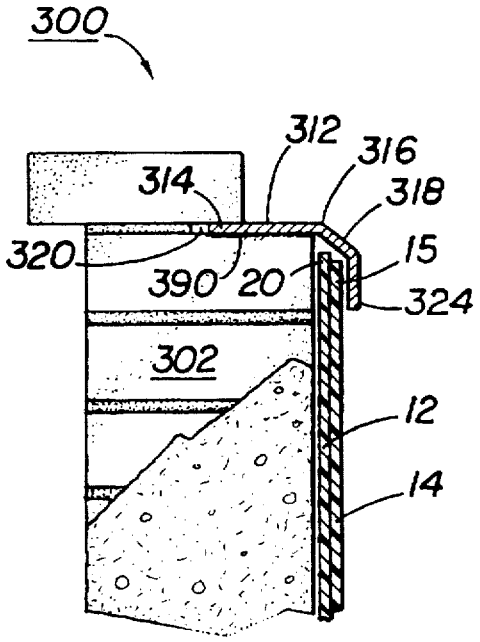

In another alternative preferred embodiment, as shown in FIG. 13*d*, the holding means 300 comprises a horizontal member 312 having a first end 314 and an opposite second end 316, which terminates in an angled or downward sloping depending wall 318. The depending wall 318 has a bottom end, and a second wall 324 depending from the bottom end of the depending wall 318. The first end 314 may be positioned and sealed with a sealant 390 adjacent the top surface of the trench wall. The trench wall 302 may define a horizontal channel 320 therein to receive the first end 314 and a portion of the horizontal member 312. The angled depending wall 318 overlies and holds in place the upper portion 15 of the primary liner means 14 and/or the upper portion 20 of the secondary liner means 12.

Installation and Operation

Figure 13B:
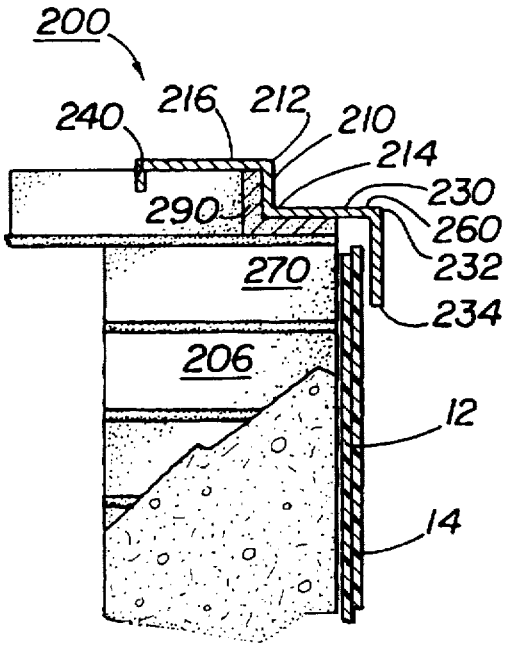
Figure 13C:
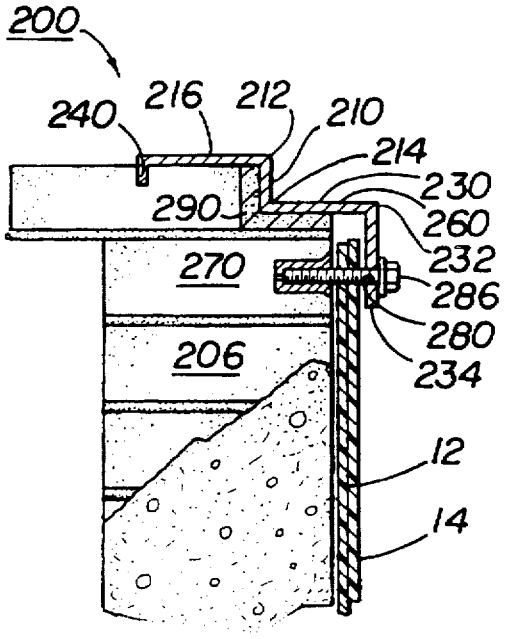

Several methods may be employed to secure the holding means 200 to the trench wall 206. In one, as shown in FIG. 13*a*, the second horizontal member 230 defines a first opening 272 therethrough and a portion of the upper end 254 of the trench wall 206 defines a second opening 284 in registry with the first opening 272 and adapted to receive a bolt 286 passing therethrough, thereby securing the holding means 200 to the trench wall 206. In addition, a sealant may be placed in the vertical channel 240 and on the inner surface 250 of vertical member 210. An alternative method of securing the holding means 200 to the trench wall 206, is shown in FIG. 13*c*, wherein the second wall 232 of the holding means 200 defines a first opening 280 therethrough and a portion of the trench wall 270 defines a second opening 284 adapted to receive a bolt 286 passing through the first opening 280. In another alternative method of securing the holding means 200, 300 as shown in FIGS. 13*b* and 13*d*, respectively. The holding means 200, 390, is secured to the existing trench wall 206, 302 with a sealant 290, 390 such as an elastically chemically resistant sealant. Similarly, cement or grout may be used to secure the holding means to the existing trench wall.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of this invention.

What is claimed is:

1. A trench liner system for lining a trench having at least two, substantially upright walls and a bottom, comprising:

a. a primary liner means, having an interior surface and an exterior surface, extending along the length of the trench;

b. means disposed between the primary liner means and the trench walls and bottom for separating the exterior surface of the primary liner means from the trench walls and bottom so as to allow independent movement of the primary liner means and the separating means for respective expansion and contraction of the primary liner means and the separating means; and c. means for holding the primary liner means against the trench walls.

2. The system of claim 1 wherein the separating means comprises a plurality of ribs spaced along, and extending above, the exterior surface of the primary liner means so that the exterior surface of the primary liner means is supported on the ribs, thereby defining between a pair of ribs, a cavity between the exterior surface of the primary liner, and the trench walls and bottom.

3. The system of claim 2 wherein the ribs are laterally disposed along the exterior surface of the primary liner means and wherein each rib has an opening therethrough defining a gap between each rib that is in fluid communication with the cavities.

4. The system of claim 2 wherein the ribs are positioned substantially longitudinally and wherein the ribs have a plurality of openings to allow for the downward flow of fluid.

5. The system of claim 1 wherein the separating means comprises a plurality of pleats spaced along and extending above the exterior surface of the primary liner means so that the exterior surface of the primary liner means is supported on the pleats, thereby defining a plurality of cavities between the exterior surface of the primary liner means, between the pleats, and the trench walls and bottom.

6. The system of claim 1, wherein the interior of the primary liner means has an upper portion and wherein the holding means comprises a horizontal member having a first end and an opposite second end, a downward sloping wall depending from the second end and having a bottom end, and a wall depending from the bottom end of the sloping wall, wherein the sloping wall and the depending wall overlie the upper portion of the primary liner means.

7. A trench liner system for lining a trench having at least two walls and a bottom, comprising:

a. secondary liner means, having an interior surface and an exterior surface, extending along the length of the trench;

b. primary liner means, having an interior surface and an exterior surface, disposed within the trench within the secondary liner means and extending along the length of the trench;

c. a first separating means disposed between the primary liner means and the secondary liner means for separating the exterior surface of the primary liner means from the interior surface of the secondary liner means;

d. a second separating means disposed between the secondary liner means and the trench walls and bottom for separating the exterior surface of the secondary liner means from the trench walls and bottom; and e. means for holding the primary liner means and secondary liner means against the trench walls.

8. The system of claim 7 wherein the first separating means comprises a plurality of ribs spaced along, and extending above, the exterior surface of the primary liner means so that the exterior surface of the primary liner means is supported on the ribs, thereby defining a plurality of cavities between the exterior surface of the primary liner, between the ribs, and the interior surface of the secondary liner means and wherein the second separating means comprises a plurality of ribs spaced along, and extending above, the exterior surface of the secondary liner means so that the exterior surface of the secondary liner means is supported on the ribs, thereby defining a plurality of cavities between the exterior surface of the secondary liner means, between the ribs, and the trench walls and bottom.

9. The system of claim 7 wherein the first separating means comprises a plurality of ribs spaced along, and extending above, the interior surface of the secondary liner means so that the exterior surface of the primary liner means is supported on the ribs, thereby defining a plurality of cavities between the exterior surface of the primary liner, between the ribs, and the interior surface of the secondary liner means and wherein the second separating means comprises a plurality of ribs spaced along, and extending above, the exterior surface of the secondary liner means so that the exterior surface of the secondary liner means is supported on the ribs, thereby defining a plurality of cavities between the exterior surface of the secondary liner means, between the ribs, and the trench walls and bottom.

10. The system of claim 8 wherein the ribs are laterally disposed along the exterior surface of the primary liner means and along the exterior surface of the secondary liner means and wherein each rib has an opening therethrough defining a gap between each rib that is in fluid communication with the cavities.

11. The system of claim 9 wherein the ribs are laterally disposed along the interior surface of the secondary liner means and along the exterior surface of the secondary liner means and wherein each rib has an opening therethrough defining a gap between each rib that is in fluid communication with the cavities.

12. The system of claim 8 wherein the ribs are positioned substantially longitudinally and wherein the ribs have a plurality of openings to allow for the downward flow of fluid.

13. The system of claim 9 wherein the ribs are positioned substantially longitudinally and wherein the ribs have a plurality of openings to allow for the downward flow of fluid.

14. The system of claim 7 wherein the first separating means comprises of pleats extending above the interior surface of the secondary liner means so that the exterior surface of the primary liner means is supported on the pleats, thereby defining a plurality of cavities between the pleats, the interior surface of the secondary liner means and the exterior surface of the primary liner means and wherein the second separating means comprises of pleats extending above the exterior surface of the secondary liner means so that the exterior surface of the secondary liner means is supported on the pleats, thereby defining a plurality of cavities between the exterior surface of the secondary liner means, between the pleats, and the trench walls and bottom.

15. The system of claim 7 wherein the first separating means comprises a plurality of pleats extending above the exterior surface of the primary liner means so that the primary liner means is supported on the pleats thereby defining a plurality of cavities between the exterior surface of the primary liner means, between the pleats, and the interior surface of the secondary liner means and wherein the second separating means comprises of pleats extending above the exterior surface of the secondary liner means so that the exterior surface of the secondary liner means is supported on the pleats, thereby defining a plurality of cavities between the exterior surface of the secondary liner means, between the pleats, and the trench walls and bottom.

16. The system of claim 7, wherein the interior surface of the primary liner means and the secondary liner means have an upper portion and wherein the holding means comprises a horizontal member having a first end and an opposite second end, a downward sloping wall depending from the second end and having a bottom end, and a wall depending from the bottom end of the sloping wall, wherein the sloping wall and the depending wall overlie the upper portion of the primary liner means and the upper portion of the secondary liner means.

* * * * *

Disclaimer 5,735,638—John V. Beamer, Atlanta, Ga. APPARATUS FOR LINING A TRENCH. Patent dated April 7, 1998. Disclaimer filed December 12, 2000, by the assignee, Hoosier Group. L.L.C.

Hereby enters this disclaimer to claims 1-16 of said patent.

*(Official Gazette, June 5, 2001)*